US006585062B2

(12) United States Patent
Rozendaal et al.

(10) Patent No.: US 6,585,062 B2
(45) Date of Patent: Jul. 1, 2003

(54) STEERABLE DIRECTIONAL DRILLING REAMER

(75) Inventors: Peter C. Rozendaal, Pella, IA (US); Scott Rempe, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/903,002

(22) Filed: Jul. 11, 2001

(65) Prior Publication Data

US 2002/0066598 A1 Jun. 6, 2002

Related U.S. Application Data

(60) Provisional application No. 60/217,563, filed on Jul. 12, 2000, and provisional application No. 60/218,008, filed on Jul. 12, 2000.

(51) Int. Cl.[7] ..... E21B 17/10
(52) U.S. Cl. ..... 175/53; 175/62; 175/405
(58) Field of Search ..... 175/19, 53, 61, 175/62, 406

(56) References Cited

U.S. PATENT DOCUMENTS 4,381,038 A * 4/1983 Sugden ..... 175/344
4,789,280 A * 12/1988 Dobat et al. ..... 409/233
5,429,198 A * 7/1995 Anderson et al. ..... 175/230

* cited by examiner

*Primary Examiner*—William Neuder

(57) ABSTRACT

A reamer with a planetary gear train for use in horizontal directional drilling allows a reaming surface of the reamer to rotate at slower speeds while simultaneously conveying more power to the reamer via fast drill string rotational speeds. The reamer may also include mixing elements that may rotate at the same speed as the drill string. The reamer may further be steerable and include an offset mount that is rotatably coupled to the reamer. The offset mount being configured to couple a ream string to the reamer in such a manner that a longitudinal axis of the ream string is not collinear with the axis of rotation of the reamer. The reamer may also include u-joints which couple the reamer to a drill string and ream string, the u-joints allowing for a greater range of angles to be achieved when tilting the reamer by means of rotating and positioning the ream line.

24 Claims, 8 Drawing Sheets

STEERABLE DIRECTIONAL DRILLING REAMER

CROSS-REFERENCE TO RELATED APPLICATIONS

This application claims the benefit of U.S. Provisional Application 60/217,563 and U.S. Provisional Application 60/218,008, both filed on Jul. 12, 2000.

FIELD OF THE INVENTION

The present invention relates generally to underground drilling machines. More particularly, the present invention relates to reamers for use in horizontal directional drilling.

BACKGROUND OF THE INVENTION

Utility lines for water, electricity, gas, telephone, and cable television are often run underground for reasons of safety and aesthetics. Sometimes, the underground utilities can be buried in a trench that is subsequently back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string about its longitudinal axis. The drill string comprises a series of drill pipes threaded together. Sliding movement of the drive mechanism along the frame, in concert with the rotation of the drill string, causes the drill string to be longitudinally advanced into or withdrawn from the ground.

In a typical horizontal directional drilling sequence, the horizontal directional drilling machine drills a hole into the ground at an oblique angle with respect to the ground surface. To remove cuttings and dirt during drilling, drilling fluid can be pumped by a pump system through the drill string, over a drill head (e.g., a cutting or boring tool) at the end of the drill string, and back up through the hole. After the drill head reaches a desired depth, the drill head is then directed along a substantially horizontal path to create a horizontal hole. Once the desired length of hole has been drilled, the drill head is then directed upwards to break through the ground surface, completing a pilot bore.

The diameter of the pilot bore so constructed typically must be enlarged. To accomplish this, a reamer (sometimes called a backreamer) is attached to the drill string which is pulled back along the path of the pilot hole, thus reaming out the hole to a larger diameter. The reamer usually includes a reaming or cutting surface on which is mounted cutting teeth or other cutting or grinding elements. It is also common to attach a utility line or other conduit product to the reamer so that the product is pulled through the hole behind the reamer as the reamer enlarges the hole.

When utilizing standard backreaming techniques a backreamer is pulled longitudinally along the path of the pilot bore. Under certain conditions, however, the backreamer may tend to deviate from the path defined by the pilot bore. For instance, typically the pilot bore and drill string lie in an arcuate shape. Therefore the longitudinal force being exerted on the drill string tends to straighten the drill string, especially when soil conditions require increased levels of force on the drill string. This straightening tendency can affect the location of the backreamer by pulling the reamer higher. In some jobs the backreamer may move as much as 12 to 18 inches from the pilot bore. Such inaccuracy can have negative effects particularly when a utility or natural obstacle such as a river is being avoided.

In other situations, where large diameter bores are being formed, the weight of the backreamer can cause deviation from the pilot bore. A backreamer can only be moved longitudinally along the pilot bore at a rate in proportion to the drilling fluid being pumped to the reamer and out of the pilot bore. Therefore, longitudinal progress may be very slow. A heavy backreamer in the right soils will tend to drop lower than the pilot bore as it rotates quickly but moves slowly longitudinally.

Typically, the limiting factor in the speed of operation for a backreamer is the flow capacity of the pump system that pumps the drilling fluid. The backreamer should only displace soil at a rate in proportion to the amount of drilling fluid being pumped and removed from the pilot bore. Reamers may include mixing elements which assist in mixing the drilling fluid with the dirt and cuttings to achieve an easily displaceable consistency. The mixing elements rotate along with the reamer. The mixing function of the mixing elements and, therefore, the speed of the entire backreaming operation improves when the mixing elements are rotated at faster spinning speeds (rpms).

Faster spinning speeds also increase the total power transferred to the reamer. The total power transferred is a function of spinning speed multiplied by torque. By increasing the spinning speed of the drill string, more power can be delivered to the backreamer.

Faster spinning speeds, however, are not always desirable. Although spinning the backreamer at higher speeds improves mixing and delivers more power to the backreamer, faster or excessive speeds can cause instability of the assembly, resulting in fluctuations in the drive torque, torque spikes, and vibrations which deleteriously affect the cutting action of the cutting elements on the reaming surface of the backreamer. Spinning the cutting surface at faster speeds may also cause difficulty in controlling the backreamer.

These drawbacks become more acute with larger backreamers, particularly for backreamers which produce bores in excess of 18 inches. The speed of an individual cutting element on a backreamer is determined by the rotational speed of the backreamer and the distance from the center of the backreamer to the cutting element. Therefore, cutting elements on larger backreamers will move faster at any given spinning speed than cutting elements on smaller backreamers. As a result, the cutting action of a large backreamer is more susceptible to the inefficient effects of faster spinning speeds.

A backreamer, then, may perform several functions including: mechanically cutting, grinding and loosening the soil to enlarge the pilot hole diameter, directing drilling fluid to assist in the cutting action, mixing the loosened soil with the drilling fluid such that the resulting slurry is a consistency that will flow out of the bore when displaced by whatever product is to be pulled in, and transferring the longitudinal force required to pull the product through the hole.

The amount of torque necessary to rotate a backreamer depends on several factors which include: the outer diameter of the backreamer, the difference between the diameter of the pilot hole and the outer diameter of the backreamer, the type of soil, the speed at which the backreamer is being rotated, and the longitudinal force being applied to the backreamer.

SUMMARY OF THE INVENTION

One aspect of the present invention relates to a backreamer assembly adapted to be rotated by a drill string. The backreamer assembly includes a reaming surface and a torque transfer gear system that transfers torque from the drill string to the reaming surface of the backreamer. The torque transfer gear system is preferably configured to drive the reaming surface at a different rotational speed than the drill string. In one embodiment, the torque transfer gear system includes one or more reduction gears that rotate the reaming surface at a slower rotational speed than the drill string.

Another aspect of the present invention relates to a planetary gear train for a backreamer. The planetary gear train allows the cutting surface of the backreamer to spin at a slower speed than the speed at which the drill string rotates, thereby supplying increased power to the backreamer without the deleterious effects of instability and excessive vibrations. The planetary gear train includes a sun gear which is coupled to the drill string and rotates at the same speed as the drill string. The sun gear engages a number of planet gears which in turn engage a ring gear. The ring gear has an outer reaming surface. By adjusting the relative diameters of the ring and sun gears, the reaming surface of the ring gear can be rotated at a smaller or larger fraction of the speed of the drill string. The planet gears are held in position by a carrier frame which does not rotate. The carrier frame may be prevented from rotating by means of anti-rotation members, by a ream string, or even by the product being pulled into the bore.

Another aspect of the present invention relates to a drive system for a backreamer with mixing elements. The drive system rotates the mixing elements at a faster speed than the cutting surface of the backreamer thereby improving the mixing function of the mixing elements without deleteriously affecting the cutting function of the backreamer.

A further aspect of the present invention relates to a method for reaming a pilot bore dug by horizontal directional drilling. The method includes rotating the drill string and a mixing element at a first speed while rotating the cutting or reaming surface of the backreamer at a second speed slower than the first speed.

Yet another aspect of the present invention relates to a backreamer adapted with an offset mount for steering the reamer as it is pulled or pushed through a pilot bore. The offset mount is rotatably coupled to the backreamer such that it may be held from rotating during operation of the backreamer. The offset mount is further configured to couple to a ream line such that the longitudinal axis of the ream line is not collinear with the axis of rotation of a drill string.

Another aspect of the present invention relates to a backreamer having an offset mount and two u-joints (i.e. universal joints), a first u-joint coupling the backreamer to a drill string and a second u-joint coupling the offset mount of the backreamer to a ream line. The u-joints assist in steering the backreamer by allowing a greater range of angles at which the backreamer may be tilted during operation.

A further aspect of the present invention relates to a method for steering a reamer during horizontal directional drilling. The method includes providing a reamer with a rotatable offset mount. The reamer is coupled to both a drill string and a ream line. Specifically, the ream line is coupled to the offset mount. Rotating and positioning the ream line controls the orientation plane of the offset mount, determining the plane in which subsequent steering corrections can be made. The ream line may, in coordination with the drilling machine, be used to control longitudinal forces applied to the offset mount thereby redirecting the reamer.

A further aspect of the present invention relates to a method for steering a reamer during horizontal directional drilling. The method includes placing u-joints at both a front end and a back end of a reamer equipped with an offset mount. The u-joints permit a greater range of angles at which the reamer may be positioned, thereby improving the steering control of the reamer.

Another aspect of the invention relates to an anchoring machine that connects to a ream string that is capable of controlling the orientation and direction of movement of a reamer equipped with an offset mount by applying longitudinal force on the ream string in forward or backward directions and by controlling rotational orientation of the offset mount.

A further aspect of the present invention relates to a method for steering a reamer during horizontal directional drilling. The method includes providing a reamer with a rotatable offset mount. The reamer is coupled to both a drill string and a ream line, the drill string being further coupled to a horizontal drilling machine and the ream line being coupled to an anchoring machine. Specifically, the ream line is coupled to the offset mount. Rotating and positioning the ream line, a function of the anchoring machine, controls the orientation plane of the offset mount, determining the plane in which subsequent steering corrections can be made. The anchoring machine can then be used, in coordination with the drilling machine to control force applied to the offset mount thereby redirecting the reamer.

Another aspect of the invention relates to a new method that involves drilling a pilot bore with a horizontal drilling machine, connecting a reamer having an offset mount to the drill string which extends through the pilot bore at an exit point such that the drill string will rotate cutting elements of the reamer, positioning an anchor machine that stores drill rod at the exit point of the pilot hole, connecting a ream string which consists of drill rods to the reamer by means of the offset mount such that the ream string does not rotate, connecting the ream string to the anchor machine, propelling the reamer back along the pilot hole by cooperation of the drilling machine and the anchor machine in a manner to control position of the reamer, the anchor machine adding to the length of the ream string while the drilling machine is reducing the length of the drill string, when the reamer exits at the entry point removing the reamer, connecting the ream string to the drilling machine thereby converting it effectively to the drill string, removing the anchor machine, connecting the product to the drill string at the exit point and pulling it in with the drilling machine.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

DETAILED DESCRIPTION

With reference now to the various drawing figures in which identical elements are numbered identically throughout, a description of various exemplary aspects of the present invention will now be provided.

The present invention relates generally to a backreamer that addresses the above-identified drawbacks. In one non-limiting embodiment, reduction gears can be used to reduce the rotational speed of the backreamer as compared to the rotational speed of the drill string. In another non-limiting embodiment, an offset mount can be used to steer the backreamer as it is pulled or pushed through a pilot bore.

Figure 1:
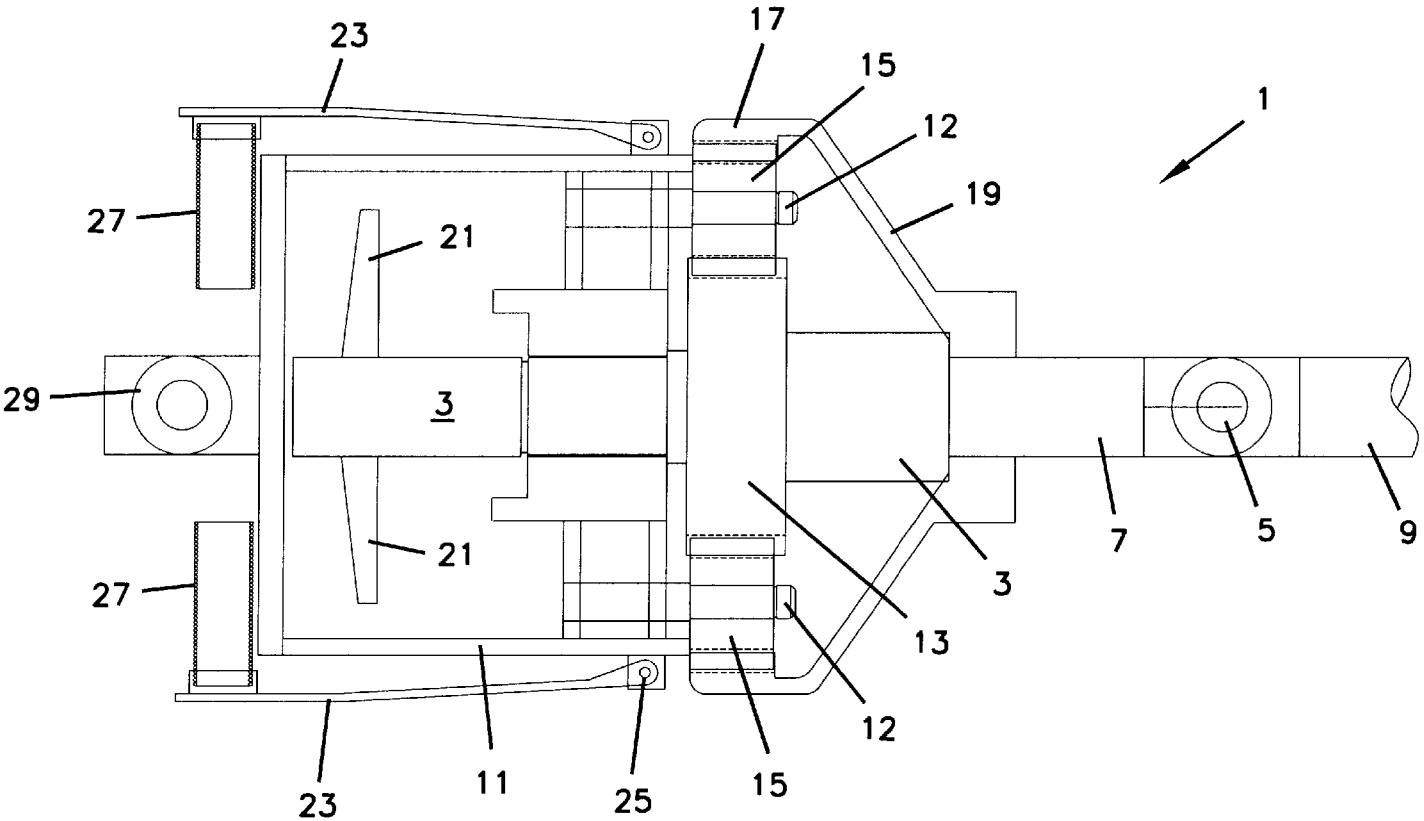
FIG. 1 is a backreamer with planetary gear system and mixing elements configured with anti-rotation elements according to the present invention.

FIG. 1 illustrates a backreamer 1 constructed in accordance with the present invention. The backreamer 1 is configured to be coupled to a drill string 9 and pulled by the drill string 9 through a pilot bore to enlarge the size of the bore. The backreamer 1 includes a drive shaft 3 which is rotated by the drill string 9. The drill string 9 is coupled to a front end 7 of the drive shaft 3 by a front coupling 5. The coupling 5 may be a u-joint coupling as is shown in FIG. 1.

A carrier frame 11 is disposed around the drive shaft 3. Preferably, the frame is coupled to the shaft 3 in such a manner that the carrier frame 11 may remain stationary while the drive shaft 3 rotates. For example, bearings may be used to allow relative rotation between the carrier frame 11 and the drive shaft 3. The carrier frame 11 includes gear spindles 12 which support planet gears 15.

The backreamer 1 also includes a planetary gear train. The planetary gear train includes a sun gear 13, a planet gear or gears 15, and a ring gear 17 sometimes referred to as an internal gear. The sun gear 13 is fixed to the drive shaft 3 and will rotate at the same speed (an equal number of revolutions per minute) as the drive shaft 3. The planet gears 15 rotate around the gear spindles 12 of the carrier frame 11 and engage both the sun gear 13 and the ring gear 17. The planet gears 15 are fixed in position by the carrier frame 11, and therefore do not revolve around the sun gear 13.

Figure 6:
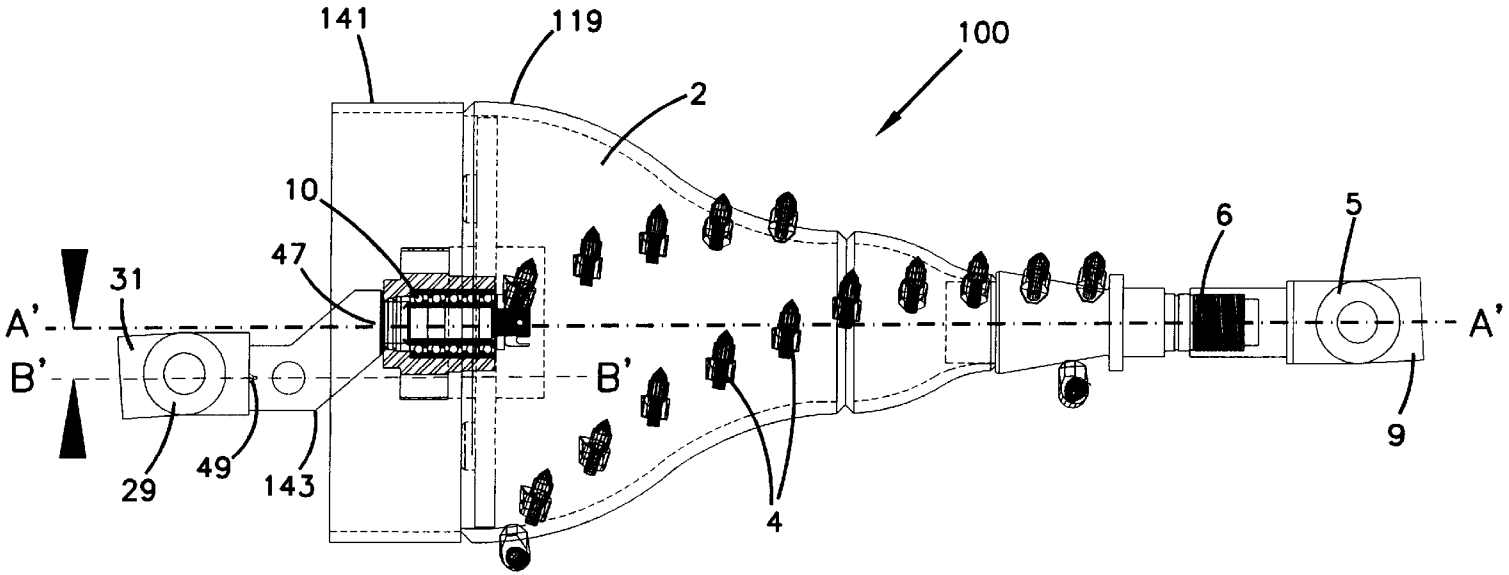
FIG. 6 is yet another embodiment of a reamer with an offset steering mount and u-joints according to the present invention.

The ring gear 17 includes a reaming surface 19 which may include cutting elements 4 (as shown in FIG. 6). The cutting elements may include cutting spikes, teeth, wedges, blades or may be auger, screw or drill shaped or may contain any other combination of cutting elements as is known in the art. The reaming surface 19 cuts and grinds dirt and stone to increase the diameter of the hole or pilot bore. The ring gear 17 is rotatably coupled to the drive shaft 3 so that the drive shaft 3 may rotate in a first direction at a first speed while the ring gear 17 rotates by action of the sun and planet gears 13 and 15 in an opposite direction to and at a slower speed (fewer revolutions per minute) than the first direction and speed of the drive shaft 3. For example, the ring gear 17 may be coupled to the drive shaft 3 using bearings to improve rotation of the ring gear 17 around the drive shaft 3.

By including a planetary gear train in the backreamer 1, more power can be delivered to the backreamer while avoiding the undesirable effects of increasing the speed of the reaming surface 19, namely, torque spikes, instability, and vibrations any of which may hinder the cutting action and control of the reaming surface 19.

The present invention also may include a mixing element or elements 21 for mixing drilling fluid with cuttings of stone and dirt to be displaced from the hole. The mixing element 21 may be shaped as a bar, a blade, a propeller, a rod or any other shape suitable for mixing the slurry. Mixing is more efficient at relatively fast spinning speeds. The present invention allows the drill string 9 and drive shaft 3 to spin the mixing element 21 at a relatively fast speed to maximize mixing efficiency while the reaming surface 19 of the ring gear 17 is spun at a relatively slow speed to maximize cutting efficiency and control. The action of the planetary gear train accomplishes this result. The same drill string powers both the mixing element 21 and the reaming surface 19, yet the two rotate at different speeds. For example, the ring gear 17 and the reaming surface 19 may rotate at one half or one third the speed of the drill string 9 and the mixing elements 21.

In order to operate correctly, the carrier frame 11 preferably does not rotate with the drive shaft 3 and the sun gear 13. Therefore, the backreamer 1 may include means for holding the carrier frame 11 stationary. The means for preventing rotation may include anti-rotation members 23 as shown in FIG. 1. The anti-rotation members 23 may be coupled to the carrier frame 11 by a hinge 25. The anti-rotation members 23 would press against the dirt wall of the bore hole to prevent the carrier frame 11 from rotating during operation. The anti-rotation members 23 may also be biased away from the carrier frame by springs 27 pressing the members 23 against the hole wall. If the backreamer also includes mixing elements 21 as shown in FIG. 1, the mixing elements 21 may also be configured to force the slurry of fluid and dirt against the anti-rotation elements 23 thereby holding the anti-rotation elements 23 against the wall of the hole.

Figure 2:
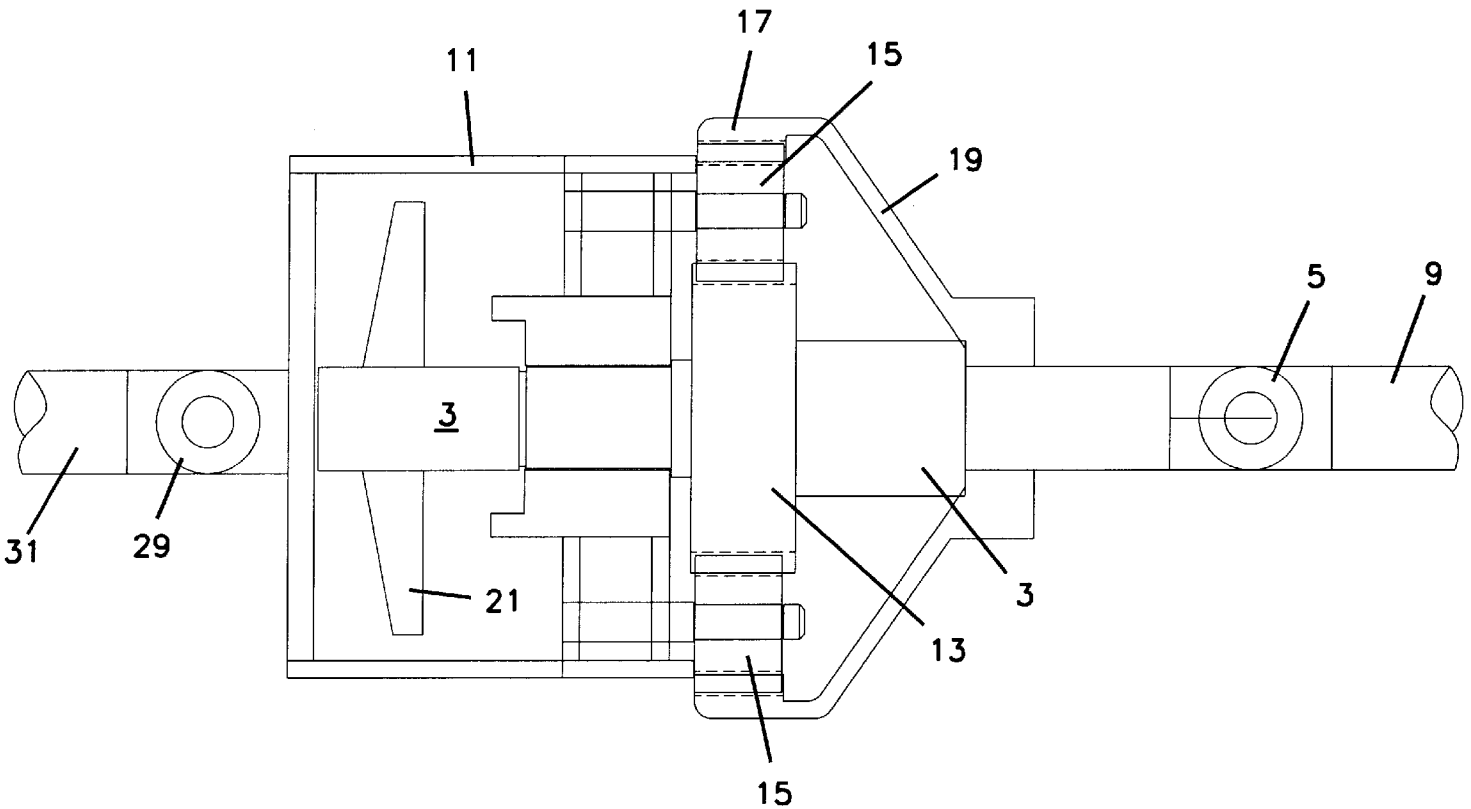
FIG. 2 is an embodiment of a backreamer configured with a ream string according to one embodiment of the present invention.
Figure 3:
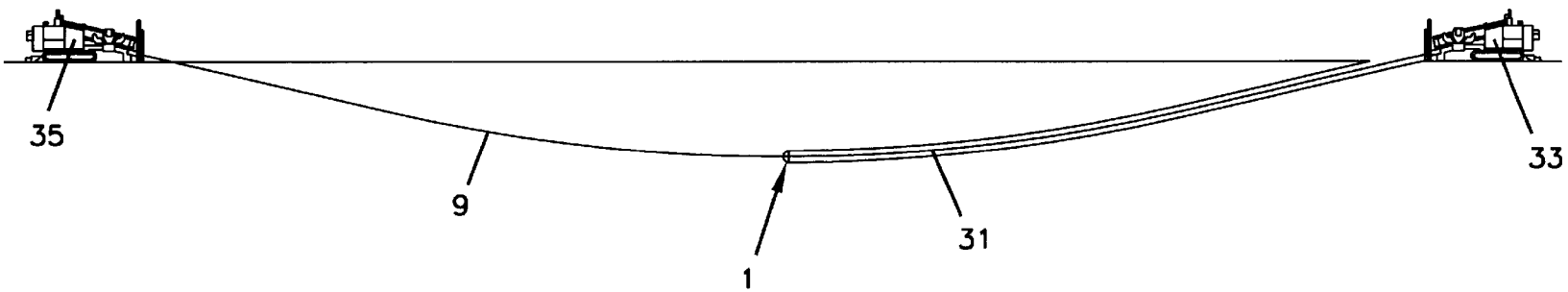
FIG. 3 shows the backreamer of FIG. 2 coupled to a drilling machine and an exit side anchor machine.

Alternatively, as shown in FIGS. 2 and 3 the carrier frame 11 may be held by coupling the carrier frame to a ream string 31 which would be coupled to an anchoring machine 33 acting as an anchor at the opposite end of the hole from the horizontal directional drilling machine 35 drawing the reamer through the pilot bore. The ream string 31 may include a ream line, a string of pipe rods identical to the drill string, or a line of product to be pulled through the final hole such as a conduit line. The ream string 31 and anchoring machine 33 would supply sufficient torque to the carrier frame 11 to prevent the carrier frame 11 from rotating. To accomplish this, the carrier frame 11 would include a rear coupling 29 to couple the carrier frame 11 to the ream string 31. The rear coupling 29 may include a u-joint coupling as shown in FIG. 2.

Figure 4:
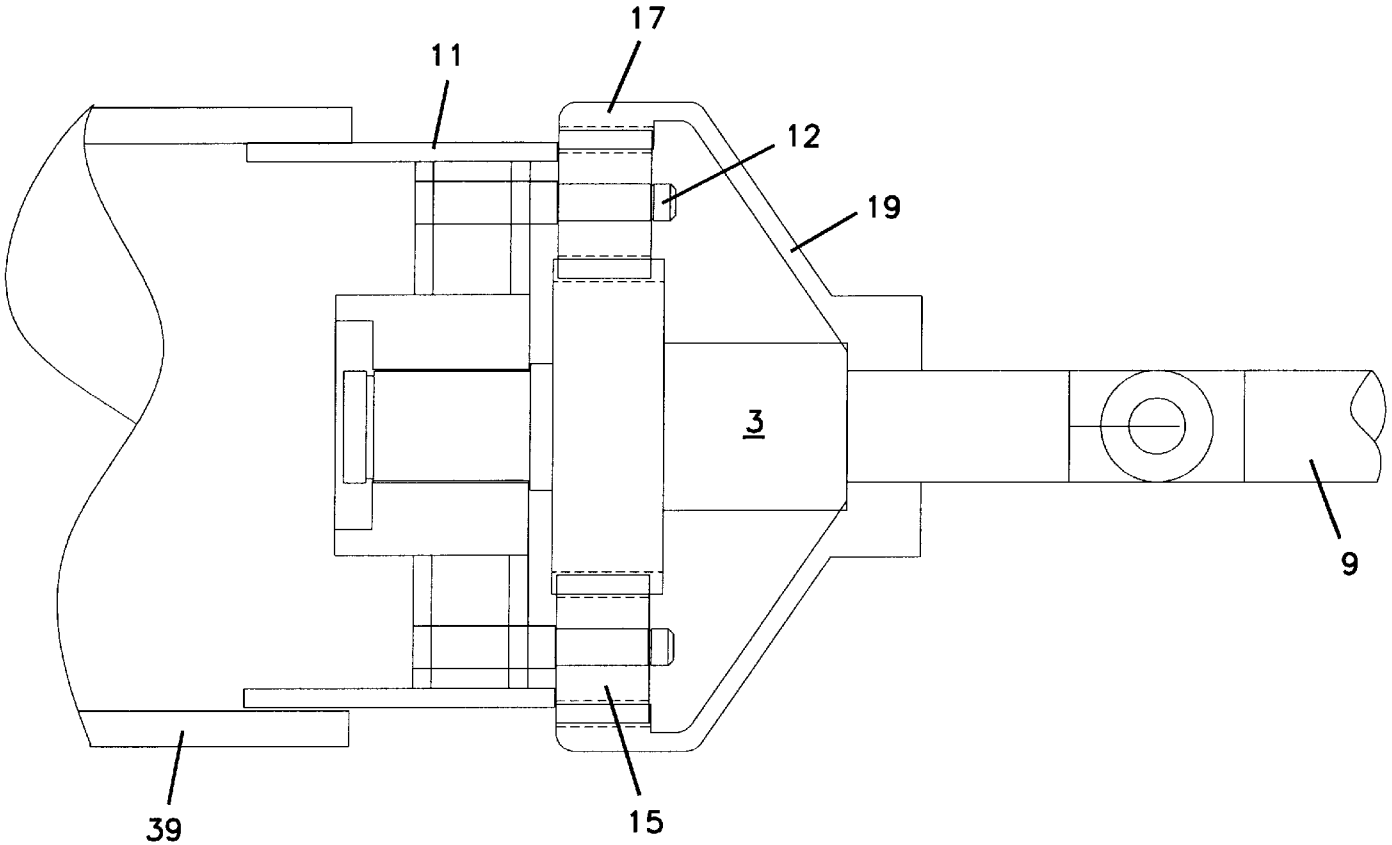
FIG. 4 shows another embodiment of a backreamer configured with conduit coupled to the carrier frame according to the present invention.

Another embodiment of the present invention is shown in FIG. 4 in which the carrier frame 11 is prevented from rotating by a product conduit line 39. The product which is intended to be run through the hole, typically a conduit line, is sometimes coupled to the backreamer during the backreaming process and pulled through the enlarged hole by the backreamer. If sufficiently rigid to withstand the torque on the carrier frame 11, the conduit line 39 can be used to prevent rotation of the carrier frame 11 during backreaming. In such a case, the carrier frame 11 would be configured to couple to the conduit line 39 by various means, such as fasteners, plugs, adapters, or threaded couplers as known in the art, depending on the configuration of the conduit line 39 being installed.

Figure 5:
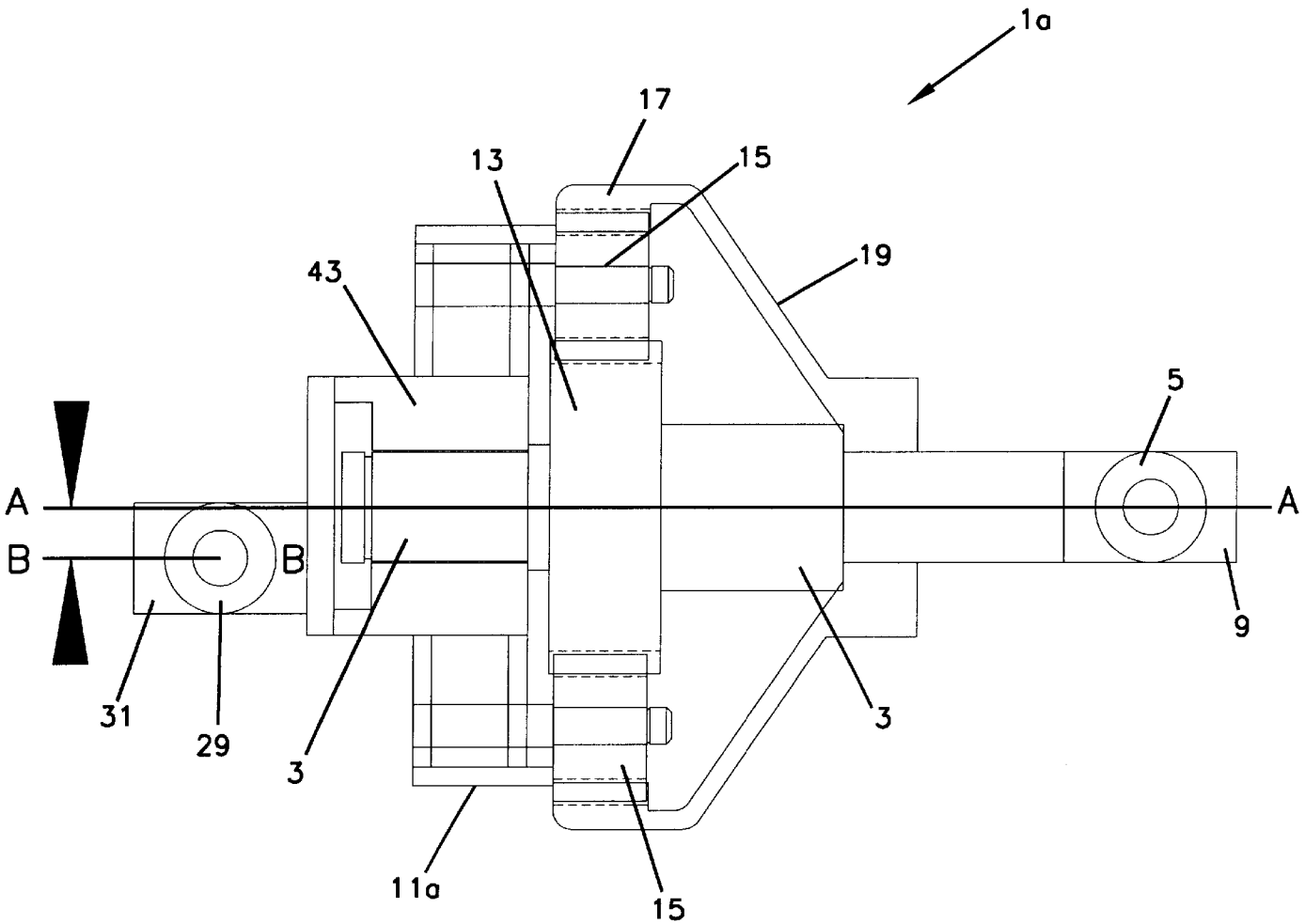
FIG. 5 is still another embodiment of a reamer with offset steering shaft and u-joints according to the present invention.

Yet another backreamer 1*a* that is an embodiment of the present invention is depicted in FIG. 5. Similar to the backreamer 1 of FIG. 1, this embodiment incorporates a planetary gear system including drive shaft 3, sun gear 13, planet gears 15 and ring gear 17. The backreamer 1*a* also includes a modified carrier frame 11*a* rotatably mounted to drive shaft 3. The carrier frame 11*a* includes an offset mount 43. The offset mount 43 is configured to be coupled to a ream string 31 so that a longitudinal axis of the ream string (line B—B) is offset from an axis of rotation of the drill string (line A—A). The carrier frame 11*a* fulfills two roles in the backreamer of FIG. 5. First, the carrier frame 11*a* prevents planet gears 15 from rotating around sun gear 13. Second, the offset mount 43 of the carrier frame 11*a* allows ream string 31 to be coupled to the backreamer 1*a*. As described later in the specification, the offset provided by the offset mount 43 assists in providing steering control of the back reamer 1*a*.

As shown in FIG. 5, backreamer 1*a* may also include u-joints 5 and 29 which assist in steering the backreamer by allowing a greater range of angles at which the backreamer may be tilted during operation. For example, u-joint 29 may couple the ream string 31 with the offset mount 43. Additionally, u-joint 5 can be used to couple the drill string 9 to the backreamer.

FIG. 6 illustrates another embodiment of a backreamer 100 constructed in accordance with the principles of the present invention. The depicted backreamer 100 includes a cutting body 2 having a reaming surface 119. The backreamer 100 is configured with threadings 6 to couple the cutting body 2 either directly to drill string 9 or to an intermediate coupling (e.g., u-joint 5). The cutting body 2 rotates about an axis of rotation shown as line A'—A' on FIG. 6.

This embodiment further includes a rear offset mount 141 including offset shaft 143. The offset mount 141 is preferably rotatably coupled to the cutting body 2 (e.g., by bearings 10) so that the offset shaft 143 will not rotate as the cutting body 2 rotates.

The offset mount 141 preferably has an axis of rotation that is collinear with the axis of rotation of drill string 9. As shown in FIG. 6, offset mount 141 and the cutting body 2 share a common axis of rotation indicated by line A'—A'. The offset shaft 143 of the offset mount 141 is configured to be coupled to the ream string 31 (e.g., by u-joint 29). The ream string 31 is characterized by a longitudinal axis. The longitudinal axis of the ream string 31 is shown as line B'—B' in FIG. 6. The ream string 31 is coupled to the offset mount 141 so that the longitudinal axis B'—B' of the ream string 31 is not collinear with the offset mount's axis of rotation A'—A'. Thus, the offset mount 141 provides for rotatably attaching a ream string 31 to the backreamer so that the ream string's longitudinal axis is offset from the axis of rotation of the drill string 9. The offset mount 141 may have many different configurations such as an angled shaft, a carrier frame, or even a simple plate.

Referring still to FIG. 6, where the offset shaft 143 has two ends, a centered end 47 and an offset end 49. The centered end 47 is rotatably coupled to the backreamer so that the shaft's axis of rotation is collinear with the axis of rotation of the drill string 9. The offset end 49 is configured to be removably coupled to a ream string 31. Because the shaft 43 is not straight, that is, because the offset end 49 of the shaft is displaced away from the shaft's axis of rotation (line A—A), the longitudinal axis of the ream string 31 (line B—B) is not collinear with the shaft's axis of rotation.

Figure 7:
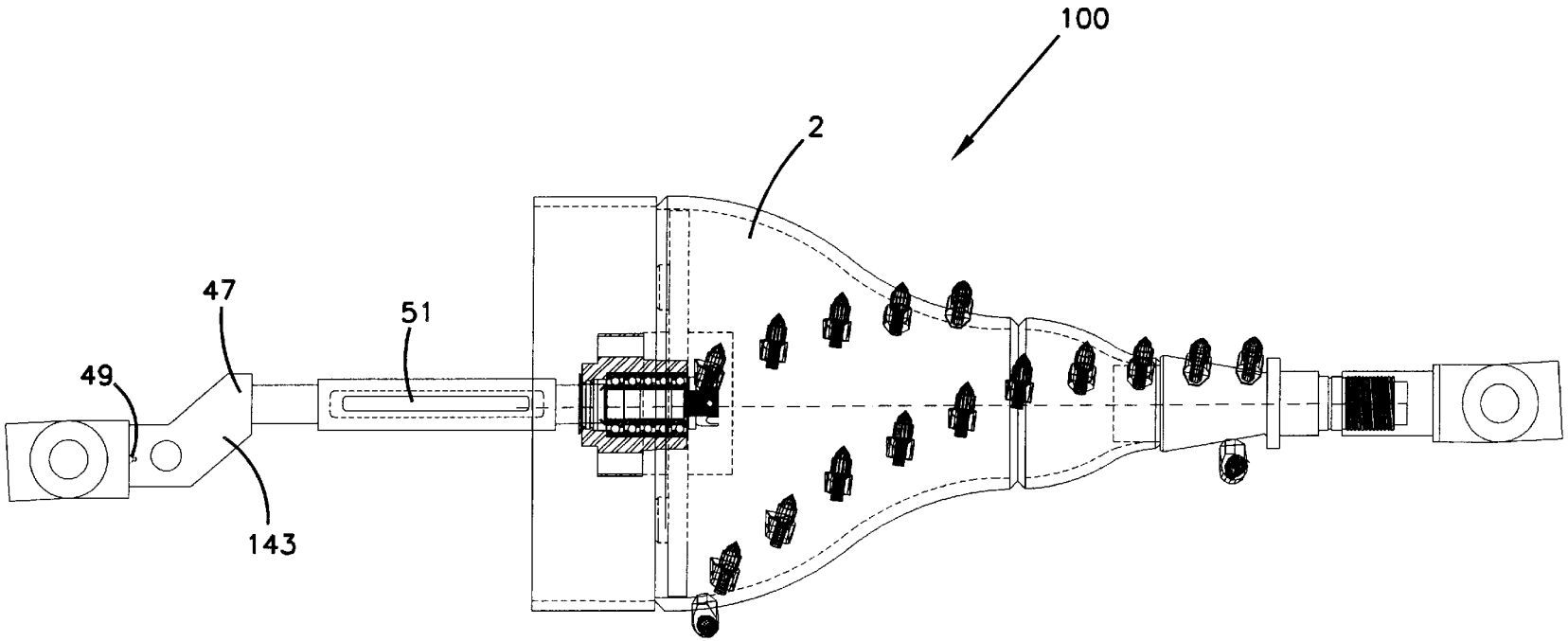
FIG. 7 is a further embodiment of a reamer with an offset mount and sonde according to the present invention.

By coupling a ream string 31 to a backreamer at a point which is offset from the backreamer's axis of rotation, it is possible to manipulate the ream string and offset mount 43, 141 and thereby reorient the attitude of the backreamer. By rotating the offset mount 43, 141 via the ream string, and applying a longitudinal force to the ream string (either pushing or pulling), the backreamer may be tilted toward a desired drilling direction. Pointing, reorienting and applying force to the offset mount 43, 141 through the ream string 31 in this manner achieves an amount of directional control and steerability during the reaming operation. The longitudinal force will have a significant effect on the directional control. The fact that longitudinal forces will affect the steering of the backreamer requires such forces to be controlled. Longitudinal forces may be controlled in a variety of methods including, but not limited to, coordination of the speed that the drilling machine is propelling the drill string with the speed that an anchoring machine is propelling the ream string, maintaining a constant force applied to the ream string by an anchoring machine, controlling the force applied to the ream string by an anchoring machine to maintain a pitch of the backreamer. Such a method would be facilitated by incorporating a sonde 51 into the backreamer as seen in FIG. 7. The sonde may include, for example, an electric beacon or other type of signaling device for transmitting signals representative of the position, pitch, and angular orientation of the backreamer to corresponding equipment located at the ground surface. An exemplary signaling system using a sonde is described in U.S. Pat. No. 6,095,260, which is herein incorporated by reference in its entirety. It is recognized that if the ream string is the product being pulled, the longitudinal force may be supplied in whole or in part by the frictional force encountered when pulling a product line into the bore. If the ream string 31 is a product line, the product preferably is sufficiently rigid to withstand the torque that is conveyed by the offset mount.

Figure 8:
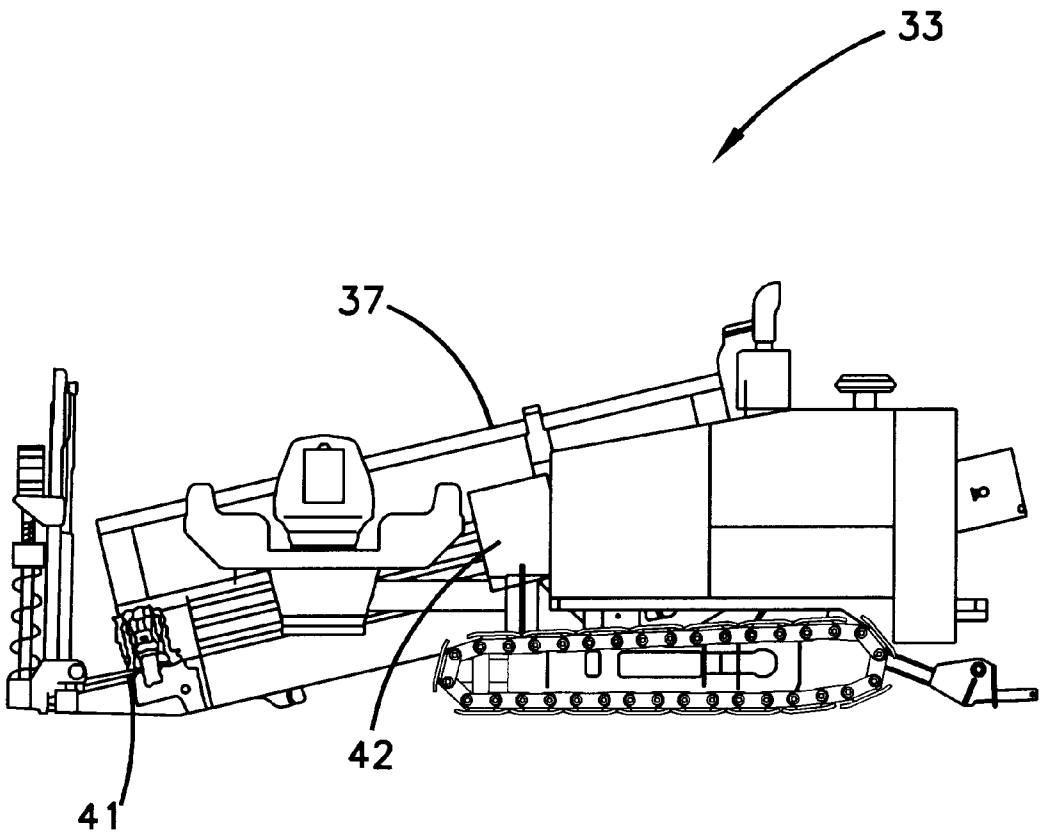
FIG. 8 is an exit side anchoring machine for use with an offset mount according to the present invention.

The ream string 31 may be coupled to an anchoring machine 33 shown in FIGS. 3 and 8. The anchoring machine 33 assists in steering the backreamer by holding the ream string 31 to prevent its rotation. To assist in steering, the anchoring machine 33 need only be able to hold the ream string 31 from rotating while simultaneously sliding the ream string 31 longitudinally as the backreamer is advanced by the drilling machine 35. The anchoring machine 33 may also assist in reorienting and steering the reamer 1 by applying a longitudinal pulling or pushing force to the backreamer via the ream string 31.

Referring now to FIG. 8, a second directional drilling machine may act as the anchoring machine 33, however, a much simpler machine may perform the functions of the anchoring machine 33. For example, unlike the directional drilling machine 35, the anchoring machine does not need to decouple or reload the rods which form the ream string 31. The anchoring machine 33 need only attach and advance additional rods into the hole being reamed. Therefore the anchoring machine may include a rod magazine and rod handling mechanism 37 that is much simpler than on a directional drilling machine 35. Similarly, because the anchoring machine 33 need not decouple the rods which form the ream string 31, the anchoring machine 33 may include a simpler, single vise system 41. Although the anchoring machine may include a rotator device 42 to rotate the ream string 31, such a device is not necessary as long as the anchoring machine is capable of withstanding sufficient torque to prevent the ream string 31 from rotating. If the anchoring machine 33 lacks the capability to rotate the ream string 31, the offset steering mount 43, 141 may be repositioned by having the anchoring machine 33 release the ream string 31 allowing the ream string 31 and offset mount 43 to rotate into the desired orientation by action of the drilling machine 35, and then re-securing the anchoring machine 33 to the ream string 31. Furthermore, because the torque, longitudinal thrust, and pulling capabilities of the anchoring machine need be much less than those required by the drilling machine 35, a much smaller machine may be used.

The anchoring machine 33 may be configured to couple either to drill rods or to product line whichever forms the ream string 31. Likewise, the offset mount 43 of the backreamer may be configured with threadings to couple to drill rods or any other of various adapters known in the art for coupling to a product line such as fasteners, plugs, adapters, or threaded couplers.

The above specification, examples and data provide a description of the invention, however, since many embodiments of the invention can be made without departing from the spirit and scope of the invention, the invention resides in the claims hereinafter appended.

We claim:

1. A reamer for use in horizontal directional drilling, the reamer comprising:

a drive shaft;

a front coupling disposed on a front end of the drive shaft, the front coupling configured to removably couple the reamer to a drill string;

a carrier frame mounted about the drive shaft;

a sun gear disposed on the drive shaft;

at least one planet gear rotatably mounted to the carrier frame, the planet gear engaging the sun gear;

a ring gear having a reaming surface, the ring gear being rotatably driven by the planet gear;

an anti-rotation member hinged to the carrier frame; and wherein when the drive shaft is rotated, torque is transferred to the ring gear through the sun and the planet gear such that the ring gear is rotated at fewer revolutions per minute than the drive shaft.

2. The reamer according to claim 1 further comprising a spring disposed between the carrier frame and the anti-rotation member, the spring biasing the anti-rotation member toward a position away from the carrier frame.

3. A reamer for use in horizontal directional drilling, the reamer comprising:

a drive shaft;

a front coupling disposed on a front end of the drive shaft, the front coupling configured to removably couple the reamer to a drill string;

a carrier frame mounted about the drive shaft;

a mixing element disposed on the drive shaft;

a sun gear disposed on the drive shaft;

at least one planet gear rotatably mounted to the carrier frame, the planet gear engaging the sun gear;

a ring gear having a reaming surface, the ring gear being rotatably driven by the planet gear;

wherein when the drive shaft is rotated, torque is transferred to the mixing element and to the ring gear through the sun gear and planet gear such that the ring gear is rotated at fewer revolutions per minute than the drive shaft and the mixing element.

4. The reamer according to claim 3 further comprising a means for preventing rotation of the carrier frame.

5. The reamer according to claim 3 further comprising a rear coupling disposed on a rear end of the carrier frame, the rear coupling configured to removably couple the carrier frame of the reamer to a ream string.

6. The reamer according to claim 3 further comprising an anti-rotation member hinged to the carrier frame.

7. The reamer according to claim 6 further comprising a spring disposed between the carrier frame and the anti-rotation member, the spring biasing the anti-rotation member toward a position away from the carrier frame.

8. The reamer according to claim 3 wherein the carrier frame is configured to be removably coupled to an end of a conduit line.

9. A method for backreaming a pilot bore in horizontal directional drilling, the method comprising:

running a drill string with a distal end through the pilot bore;

coupling a backreamer including a mixing element and a reaming surface to the distal end of the drill string;

pumping drilling fluid to the backreamer;

rotating the reaming surface at a first speed while simultaneously rotating the mixing elements at a second speed faster than the first speed;

drawing the rotating drill string and backreamer along the length of the pilot bore; and mixing the drilling fluid with dirt and cuttings into a slurry and displacing the slurry from the pilot bore.

10. A reamer assembly adapted to be driven by a drill string, the reamer assembly comprising:

a reamer having a reaming surface;

a torque transfer gear system for transferring torque from the drill string to the reamer, the torque transfer gear system being configured to rotate the reamer at a different speed than the drill string; and a mixing element coupled to the torque transfer gear system.

11. The reamer assembly of claim 10 wherein the reamer is rotated at a slower speed than the drill string.

12. The reamer assembly of claim 10 wherein the mixing element is rotated at a faster speed than the reamer.

13. A steerable reamer for use in horizontal directional drilling, the reamer comprising:

a cutting body having an axis of rotation and configured to be removably coupled to a drill string; and an offset mount rotatably coupled to the cutting body such that the axis of rotation of the offset mount is collinear with the axis of rotation of the cutting body, the offset mount configured to be removably coupled to a ream line such that a longitudinal axis defined by the ream line is not collinear with the axis of rotation of the offset mount.

14. The reamer of claim 13 further comprising a back u-joint configured to couple the offset mount to the ream line.

15. The reamer of claim 14 further comprising a front u-joint configured to couple the drill string to the cutting body.

16. A steerable reamer for use in horizontal directional drilling, the reamer comprising:

a cutting body having a front end and a back end and defining an axis of rotation;

a front coupling configured to removably couple the front end of the cutting body to a drill string;

a steering shaft having a front end and a back end, the front end of the steering shaft being rotatably coupled to the back end of the cutting body and centered on the cutting body's axis of rotation, the back end of the steering shaft being offset from the cutting body's axis of rotation; and a rear coupling configured to removably couple the back end of the steering shaft to a ream line.

17. The steerable reamer of claim 16 wherein the front coupling is coupled to the drill string by a front u-joint, and further wherein the back coupling is coupled to the ream line by a back u-joint.

18. A steerable reamer for use in horizontal directional drilling, the reamer comprising:

a drive shaft characterized by an axis of rotation and configured to be removably coupled to a drill string;

a carrier frame offset mount rotatably coupled to the drive shaft, the carrier frame offset mount configured to be coupled to a ream line such that a longitudinal axis of the ream line is not collinear with the axis of rotation of the drive shaft;

a sun gear disposed on the drive shaft;

at least one planet gear rotatably mounted to the carrier frame offset mount, the planet gear engaging the sun gear;

a ring gear having a cutting surface rotatably coupled to the drive shaft, the ring gear being rotatably driven by the planet gear;

wherein when the drive shaft is rotated, torque is transferred to the ring gear through the sun and the planet gears.

19. The reamer of claim 18 wherein the drive shaft is coupled to the drill string by a front u-joint, and further wherein the carrier frame offset mount is coupled to the ream line by a back u-joint.

20. A method for steering a reamer while reaming a pilot bore in horizontal directional drilling, the method comprising:

providing a reamer having an offset mount that is rotatably coupled to a distal end of the reamer, the reamer being coupled to a drill string, the offset mount being coupled to a ream line;

rotating and positioning the ream line to adjust the positioning of the offset mount and reamer, thereby inducing a change in the attitude of the reamer as the reamer is pulled through the pilot bore.

21. The method of claim 20 further comprising the step of providing a front u-joint to couple the reamer to the drill string and a distal u-joint to couple the offset mount of the reamer to the ream string.

22. The method of claim 20 wherein the drill string is coupled to a horizontal drilling machine and the ream line is coupled to an anchoring machine and further comprising the step of applying longitudinal force to the reamer by means of the anchoring machine to assist in redirecting the reamer.

23. A method for horizontal directional drilling, the method comprising:

drilling a pilot bore from an entry point to an exit point with a drilling machine;

connecting a reamer having an offset mount to a drill string which extends through the pilot bore at the exit point;

positioning an anchor machine at the exit point of the pilot hole;

connecting a ream line both to the reamer by means of the offset mount and to the anchor machine such that the anchor machine prevents the ream line from rotating;

propelling the reamer back along the pilot bore by cooperation of the drilling machine and the anchor machine thereby reaming a hole, the anchor machine adding to the length of the ream line in the hole while the drilling machine is reducing the length of the drill string; and removing the reamer when the reamer exits at the entry point.

24. The method of claim 23 further comprising the steps of:

connecting the ream line to the drilling machine;

removing the anchor machine from the ream line;

connecting a product line to the ream string at the exit point; and pulling the product line into the hole with the drilling machine.

* * * * *